US009362674B1

(12) United States Patent
Don

(10) Patent No.: US 9,362,674 B1
(45) Date of Patent: Jun. 7, 2016

(54) ELECTRICAL CONNECTOR BRACE

(71) Applicant: Joan Don, Lindsay (CA)

(72) Inventor: Joan Don, Lindsay (CA)

( * ) Notice: Subject to any disclaimer, the term of this patent is extended or adjusted under 35 U.S.C. 154(b) by 0 days.

(21) Appl. No.: 14/844,254

(22) Filed: Sep. 3, 2015

(51) Int. Cl.
*H01R 13/62* (2006.01)
*H01R 13/639* (2006.01)
*H01R 13/58* (2006.01)

(52) U.S. Cl.
CPC ..... *H01R 13/639* (2013.01); *H01R 13/5845* (2013.01)

(58) Field of Classification Search
CPC . H01R 13/58; H01R 13/5804; H01R 13/5812
USPC ..... 439/147, 296, 345, 371
See application file for complete search history.

(56) References Cited

U.S. PATENT DOCUMENTS 4,944,685 A 7/1990 Schulte
5,080,598 A 1/1992 Shotey
5,573,420 A * 11/1996 Grosswendt ..... H01R 13/6392 24/16 PB
7,648,372 B2 * 1/2010 Wu ..... H01R 13/516 439/41
8,435,067 B2 5/2013 Wegener
8,485,842 B2 * 7/2013 Oue ..... G02B 23/26 439/452
2014/0354216 A1 12/2014 Lin
2015/0018049 A1 1/2015 Baschnagel
2015/0099379 A1 * 4/2015 Borden ..... H01R 13/44 439/133
2015/0340809 A1 * 11/2015 Lin ..... H01R 9/18 439/345

FOREIGN PATENT DOCUMENTS

CN 203218587 U 9/2013
CN 103904732 A 7/2014

* cited by examiner

*Primary Examiner* — Vanessa Girardi

(57) ABSTRACT

An electrical connector brace can include a first member and a second member. Both members can include a barrel, a groove, and a yoke. Each barrel can extend along a longitudinal axis. Each groove can extend along the longitudinal axis within the respective barrel. Each yoke can be integrally-formed with the respective barrel and be adjacent to the respective barrel along the longitudinal axis. The first member can have a first modulus of elasticity and a first elastic limit. The second member can have a second modulus of elasticity and a second elastic limit. The first barrel can be received in the second barrel and the second yoke can overlay the first yoke.

20 Claims, 5 Drawing Sheets

ELECTRICAL CONNECTOR BRACE

BACKGROUND

1. Field

The present disclosure relates to electrical connectors and more particularly to structures that inhibit damage to electrical connectors.

2. Description of Related Prior Art

U.S. Pat. No. 4,944,685 discloses a CONNECTOR PROTECTOR. The protector for cable connectors has a double walled sleeve of flexible fabric material. Soft padding material is disposed within the double walls of the sleeve. Each open end of the sleeve includes strips of opposing hook and loop fastening material. In use, the sleeve is inserted over a connector and cable. When the connector is connected to its mating connector, the sleeve has its ends closed around the cable adjacent the connector. When the connector is disconnected, the sleeve is opened and moved to enclose the connector. The open end is closed and the other end closed around the cable.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

An electrical connector brace can include a first member and a second member. The first member can include a first barrel, a first groove, and a first yoke. The first barrel can extend along a longitudinal axis. The first groove can extend along the longitudinal axis within the first barrel. The first yoke can be integrally-formed with the first barrel and be adjacent to the first barrel along the longitudinal axis. The first member can have a first modulus of elasticity and a first elastic limit. The second member can include a second barrel, a second groove, and a second yoke. The second barrel can extend along the longitudinal axis. The second groove can extend along the longitudinal axis within the second barrel. The second yoke can be integrally-formed with the second barrel and be adjacent to the second barrel along the longitudinal axis. The second member can have a second modulus of elasticity and a second elastic limit. The first barrel can be received in the second barrel and the second yoke can overlay the first yoke.

BRIEF DESCRIPTION OF THE DRAWINGS

The detailed description set forth below references the following drawings.

DETAILED DESCRIPTION

Figure 1:
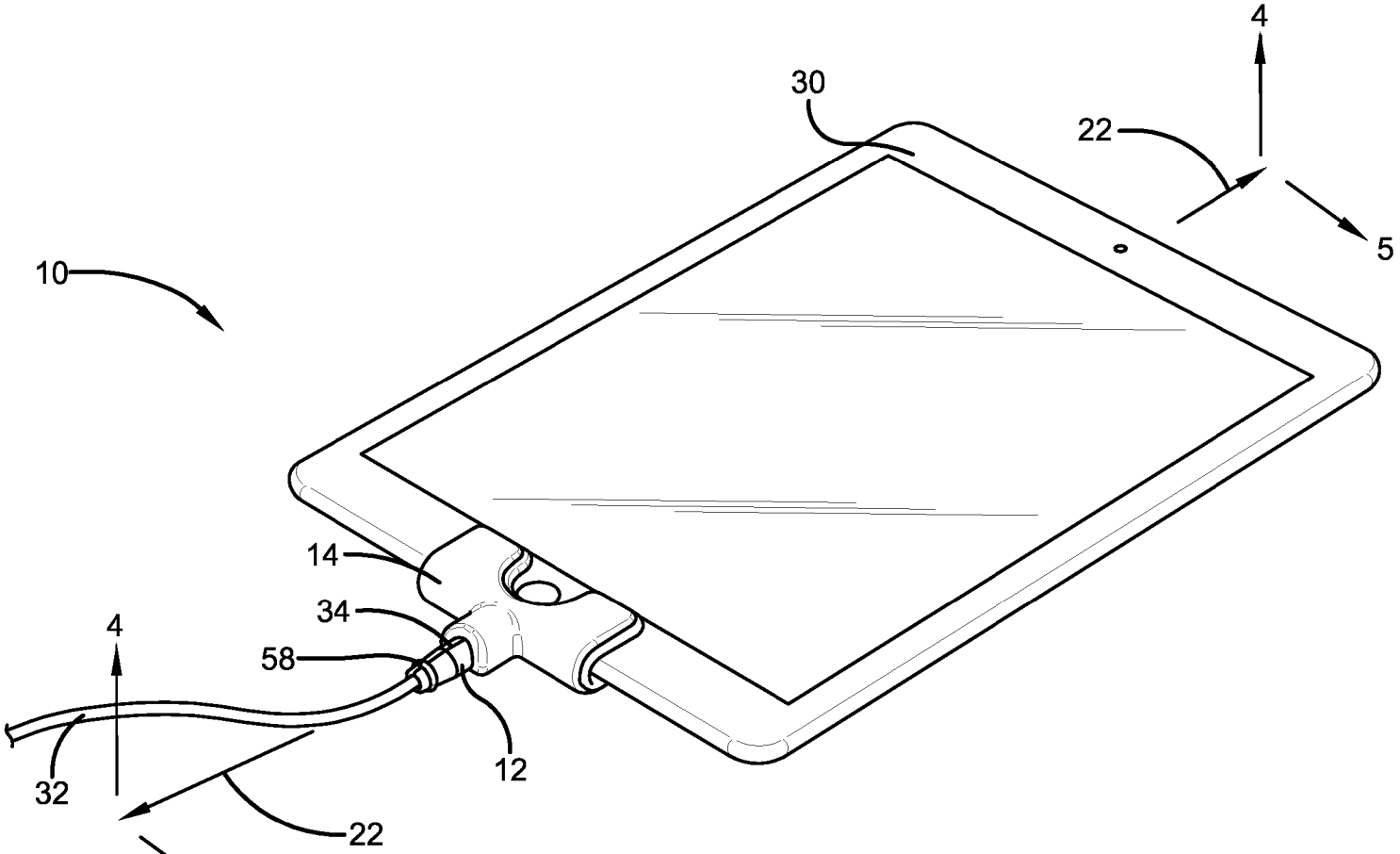
FIG. 1 is a perspective view of an exemplary embodiment of the present disclosure in operation.

The present disclosure, as demonstrated by the exemplary embodiment described below, can provide a brace to inhibit damage to electrical connectors. FIG. 1 illustrates an electrical connector brace 10 engaged with a tablet computing device 30. The electrical connector brace 10 is positioned to support an electrical connector/cable 32 plugged into the device 30. In other embodiments of an electrical connector brace according to the present disclosure can be configured to inhibit damage to electrical connectors/cables associated with other electronic devices such as smart phones, music players, video players, or any other electrical device.

In the exemplary embodiment, the electrical connector brace 10 can include a first member 12 and a second member 14. The first member 12 can include a first barrel 16, a first groove 18, and a first yoke 20. The first barrel 16 can extend along a longitudinal axis 22. The first groove 18 can extend along the longitudinal axis 22 within the first barrel 16. In various embodiments of the present disclosure, a groove can be a portion of an aperture (a structure having a closed profile) or be a portion of a slot (a structure having an open profile). The first yoke 20 can be integrally-formed with the first barrel 16 and be adjacent to the first barrel 16 along the longitudinal axis 22. The first member 12 can have a first modulus of elasticity and a first elastic limit. The first modulus of elasticity can be relatively low; the first member 12 can be formed from rubber, silicone, or some other relatively pliable, easily-deformable material.

Solid structures will deform when a force (or load) is applied to the structure. Elasticity is the property of a material to return to an original shape after being deformed by the application of a load. The amount of elasticity of a material is defined by two parameters. The first parameter is called the modulus which correlates the amount of load per unit area (stress) to an amount of deformation. The unit of measurement of the modulus is the Pascal (Pa). A higher modulus corresponds to a material that is harder to deform. The second parameter of elasticity is the elastic limit. The elastic limit is defined by a level stress beyond which the material no longer behaves elastically and plastic (non-recoverable) deformation of the material take places. After plastic deformation occurs, the material will not return to its original shape after the load is removed. Forms of rubber typically have a low modulus and tend to have a high elastic limit. Metals typically have a high modulus and a high elastic limit.

"Integrally-formed" refers to the fact that in the exemplary embodiment the [parts] are formed together rather than being formed separately and then subsequently joined. The term defines a structural feature since structures that are integrally-formed are structurally different than structures that are comprised of subcomponents formed separately and then subsequently joined. "Integral" means consisting or composed of parts that together constitute a whole and thus encompasses structures of more than one part wherein the parts are either integrally-formed or formed separately and then subsequently joined.

The second member 14 can include a second barrel 24, a second groove 26, and a second yoke 28. The second barrel 24 can extend along the longitudinal axis 22. The second groove 26 can extend along the longitudinal axis 22 within the second barrel 24. The second yoke 28 can be integrally-formed with the second barrel 24 and be adjacent to the second barrel 24 along the longitudinal axis 22. The second member 14 can have a second modulus of elasticity and a second elastic limit. The first barrel 16 can be received in the second barrel 24 and the second yoke 28 can overlay the first yoke 20.

The second modulus of elasticity can be greater than the first modulus of elasticity. The second member 14 can thus be more rigid than the first member 12. The second member 14 can be formed from a rigid plastic such as high-density polyethylene (HDPE) or polypropylene (PP).

The electrical connector brace 10 of claim 1 wherein the first barrel 16 is discontinuous about the first groove 18 relative to the longitudinal axis 22. A line 34 is referenced in FIG. 1 and represents a slit in the first barrel 16 that extends the first groove 18. The cable 32 can be inserted into the first groove 18 through the slit 34. The second barrel 24 can be continuous about the second groove 26 relative to the longitudinal axis 22.

Figure 2:
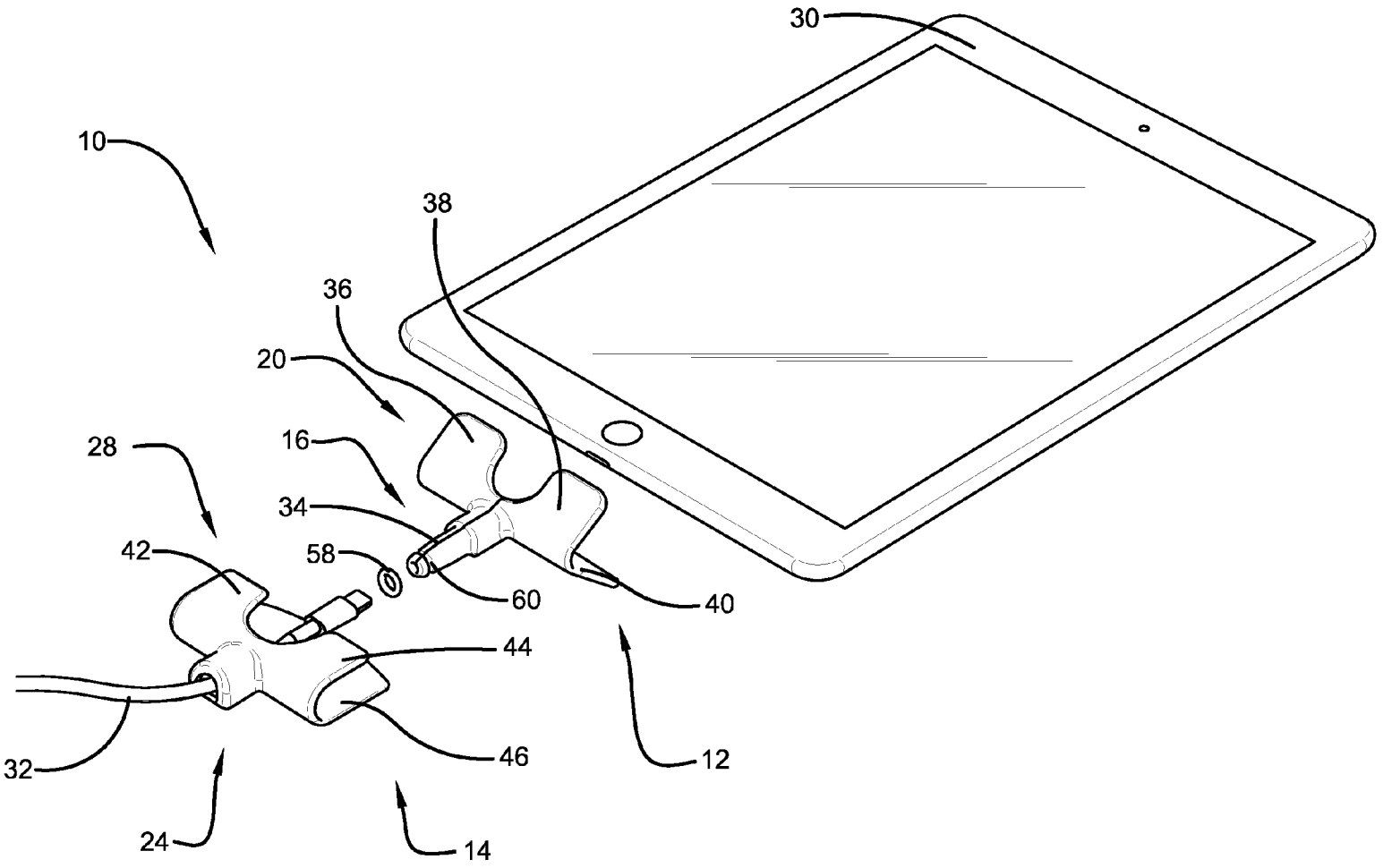
FIG. 2 is an exploded view of the exemplary embodiment shown in FIG. 1.
Figure 3:
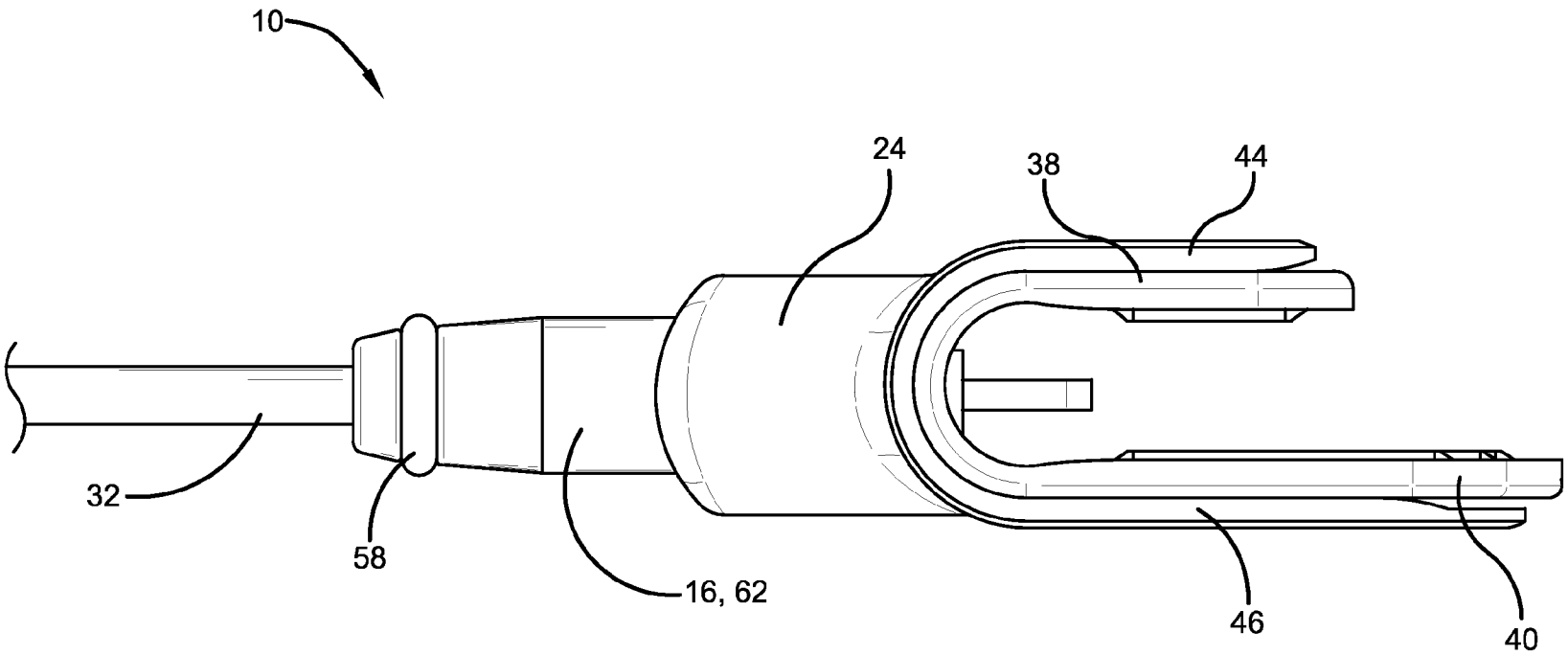
FIG. 3 is a side view of the exemplary embodiment shown in FIG. 1.
Figure 4:
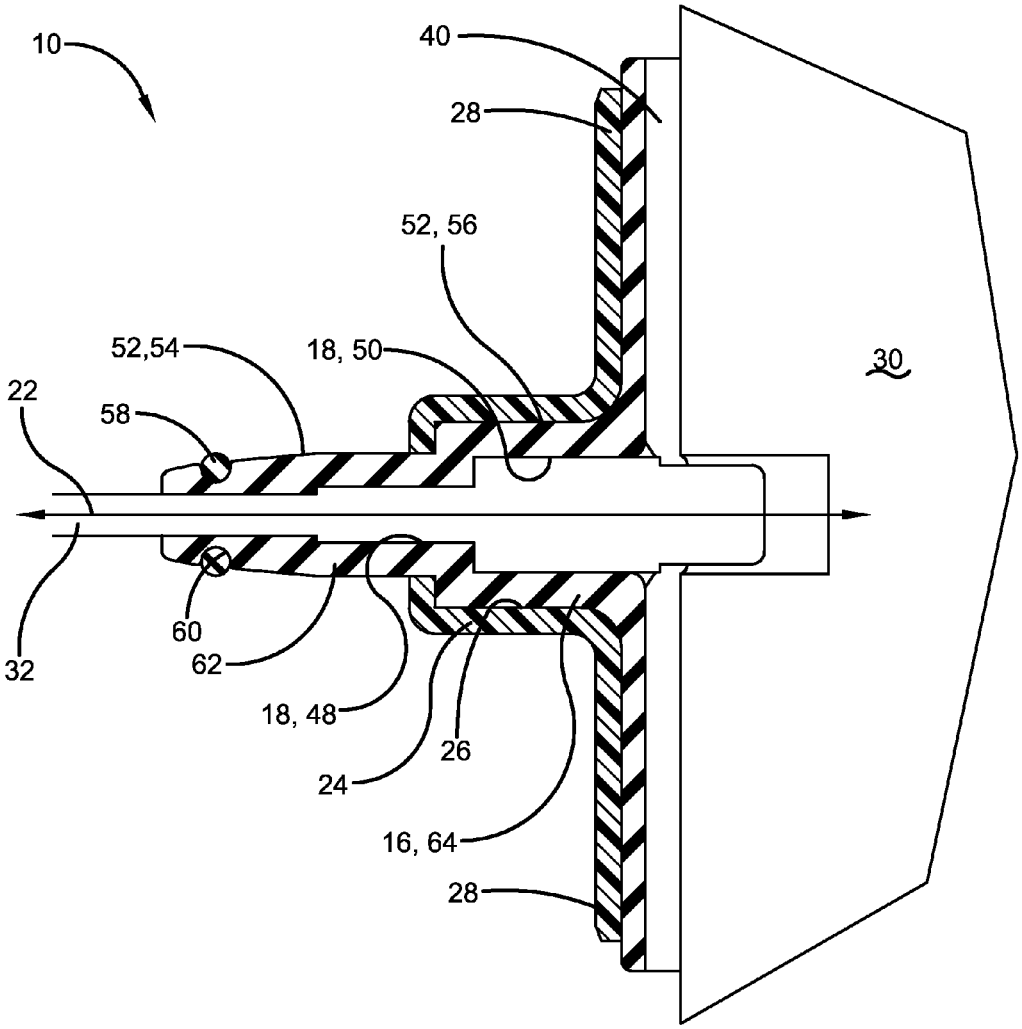
FIG. 4 is a partial cross-sectional view take through section lines 4-4 in FIG. 1.
Figure 5:
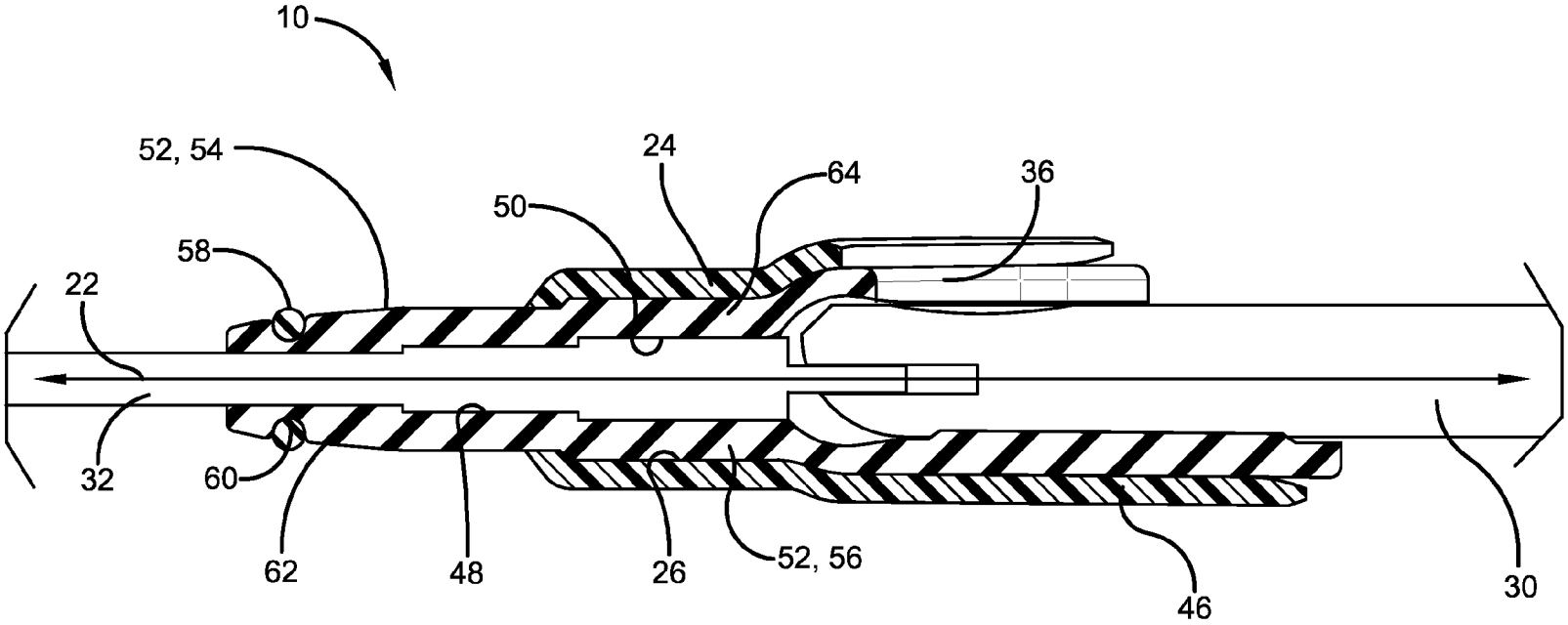
FIG. 5 is a partial cross-sectional view take through section lines 5-5 in FIG. 1.

One or both of the yokes 20, 28 can include a plurality of tines. In the exemplary embodiment, each of the yokes 20, 28 can include tines on opposite sides of the longitudinal axis 22. The first yoke 20 can include a first tine 36 and a second tine 38 extending parallel to one another on a first side of the longitudinal axis 22. The first yoke 20 can include third tine 40 on a second side of the longitudinal axis 22 opposite the first side. The second yoke 28 can include matching tines 42, 44, 46 for each of the tines 36, 38, 40. In operation, the second yoke 28 can deform the first yoke 20. FIG. 2 shows the yoke 20 in an unloaded condition. FIG. 1 shows the yoke 20 in the operating condition.

The first groove 18 can have a variable width along the longitudinal axis 22. The first groove 18 can include a first portion 48 being substantially cylindrical and second portion 50 adjacent to the first portion 48 along the longitudinal axis 22 being substantially cubic. The first portion 48 can correspond to the size and shape of the cable portion of the connector/cable 32 such that the cable portion of the connector/cable 32 is not loose with the first portion. The second portion 50 can correspond to the size and shape of the connector portion of the connector/cable 32 such that the connector portion of the connector/cable 32 is not loose with the second portion 50. The second portion 50 can be disposed at a root of the first yoke 20 and can be open to a gap between tines of the first yoke 20.

The first barrel 16 can have a variable width along the longitudinal axis 22. The first barrel 16 can include a first portion 62 extending out of the second member 14 and a second portion 64 positioned in the second groove 26. The first barrel 16 can include an outer surface 52 received in the second groove 26. The outer surface 52 can include a first portion 54 sized to pass through the second groove 26 and a second portion 56 sized larger than a smallest portion of the second groove 26. The engagement between the second portion 56 and the second groove 26 prevents the first member 12 from passing through the second groove 26.

The first barrel 16 can be shaped to simplify assembly of the brace 10, the connector/cable 32, and device 30. The outer surface 52 can include at least one portion that is asymmetric across opposite sides of at least one axis passing perpendicular to the longitudinal axis 22. For example, the second portion 56 can have a flat, downwardly-facing edge and an arcuate upwardly facing edge. This profile is symmetric about a vertical axis passing through the longitudinal axis 22 but is asymmetric about a horizontal axis passing through the longitudinal axis 22. The second portion 56 contacts and abuts the second groove 26 and allows the first member 12 to be received in the second groove 26 in one way. This allows the orientation of the connector portion of the connector/cable 32 to be oriented as desired for insertion in the device 30.

The electrical connector brace 10 can also include an o-ring 58 encircling a portion of the first barrel 16. The o-ring 58 can encircle a portion of the first barrel 16 extending out of the second groove 26, spaced from the second member 14 along the longitudinal axis 22. The first barrel 16 can include an annular notch 60 extending about the longitudinal axis 22 and the o-ring 58 can be positioned in the annular notch 60. The o-ring 58 can maintain the discontinuous portion of the first barrel 16 in a closed configuration.

In one exemplary approach to assembling the brace 10 for use, the connector/cable 32 can be passed through the second groove 26 and the o-ring 58. The connector/cable 32 can then be inserted in the first groove 18 through the slit 34. The o-ring 58 can be positioned in the annular groove 60. The first barrel 16 can then be passed though the second groove 26 until the second portion 56 is slid into the second groove 26 and bottoms in the second groove 26. Alternatively, the connector portion of the connector/cable 32 can be plugged into the device 10. Subsequently, the second member 14 can be urged toward the device 10, pressing the tines 36, 38, 40 against the device 10, until the second portion 56 bottoms in the second groove 26.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. Further, the "present disclosure" as that term is used in this document is what is claimed in the claims of this document. The right to claim elements and/or sub-combinations that are disclosed herein as other present disclosures in other patent documents is hereby unconditionally reserved.

What is claimed is:

1. An electrical connector brace comprising:

a first member having a first barrel extending along a longitudinal axis, a first groove extending along said longitudinal axis within said first barrel, and a first yoke integrally-formed with said first barrel and adjacent to said first barrel along said longitudinal axis, said first member having a first modulus of elasticity and a first elastic limit;

a second member having a second barrel extending along said longitudinal axis, a second groove extending along said longitudinal axis within said second barrel, and a second yoke integrally-formed with said second barrel and adjacent to said second barrel along said longitudinal axis, said second member having a second modulus of elasticity and a second elastic limit; and wherein said first barrel is received in said second barrel and said second yoke overlays said first yoke.

2. The electrical connector brace of claim 1 wherein said second modulus of elasticity is greater than said first modulus of elasticity.

3. The electrical connector brace of claim 1 wherein said first barrel further comprises an outer surface received in said second groove, said outer surface having a first portion sized to pass through said second groove and a second portion sized larger than a smallest portion of said second groove.

4. The electrical connector brace of claim 1 wherein said first yoke further comprises a plurality of tines including a single, first tine on a first side of said longitudinal axis and second and third tines on a second side of said longitudinal axis opposite the first side.

5. The electrical connector brace of claim 1 wherein said second yoke deforms said first yoke.

6. The electrical connector brace of claim 1 wherein said first barrel further comprises an outer surface including at least one portion being asymmetric across opposite sides of at least one axis passing perpendicular to said longitudinal axis.

7. The electrical connector brace of claim 6 wherein said at least one portion contacts and abuts said second groove.

8. The electrical connector brace of claim 1 wherein said first barrel is discontinuous about said first groove relative to said longitudinal axis.

9. The electrical connector brace of claim 8 wherein said second barrel is continuous about said second groove relative to said longitudinal axis.

10. The electrical connector brace of claim 8 wherein said first yoke includes a first tine and a second tine extending parallel to one another on one side of said longitudinal axis.

11. The electrical connector brace of claim 10 wherein said second yoke includes a third tine and a fourth tine extending parallel to one another on said one side of said longitudinal axis.

12. The electrical connector brace of claim 1 wherein said first groove has a variable width along said longitudinal axis.

13. The electrical connector brace of claim 12 wherein said first barrel has a variable width along said longitudinal axis.

14. The electrical connector brace of claim 12 wherein said first groove includes a first portion being substantially cylindrical and second portion adjacent to said first portion along said longitudinal axis being substantially cubic.

15. The electrical connector brace of claim 14 wherein said second portion is disposed at a root of said first yoke and is open to a gap between tines of said first yoke.

16. The electrical connector brace of claim 1 further comprising:

an o-ring encircling a portion of said first barrel.

17. The electrical connector brace of claim 16 wherein said o-ring encircles a portion of said first barrel extending out of said second groove.

18. The electrical connector brace of claim 16 wherein said first barrel further comprises an annular notch extending about said longitudinal axis, said o-ring positioned in said annular notch.

19. The electrical connector brace of claim 16 wherein said first barrel includes a discontinuous portion about said first groove along at least a portion of said longitudinal axis and said o-ring maintains said discontinuous portion in a closed configuration.

20. The electrical connector brace of claim 16 wherein said o-ring is spaced from said second member along said longitudinal axis.

* * * * *